United States Patent [19]

Kaffka

[11] 4,051,955

[45] Oct. 4, 1977

[54] APPARATUS FOR CHANGING CONTAINERS AT AN EJECTION OPENING OF A REFUSE PRESS

[75] Inventor: Dietmar Kaffka, Willich, Germany

[73] Assignee: Lindemann Maschinenfabrik GmbH, Dusseldorf, Germany

[21] Appl. No.: 729,981

[22] Filed: Oct. 6, 1976

[30] Foreign Application Priority Data

Apr. 7, 1976 Germany ..... 2614921

[51] Int. Cl.[2] ..... B65B 63/02

[52] U.S. Cl. ..... 214/1 BB; 53/124 B; 100/229 A; 198/485; 198/774

[58] Field of Search ..... 100/229 A; 214/1 B, 214/1 BB; 53/124 B, 124 D; 198/485, 774

[56] References Cited

U.S. PATENT DOCUMENTS

| | | | |
|---|---|---|---|
| 3,889,821 | 6/1975 | Bowers | 214/1 BB |
| 3,934,731 | 1/1976 | Muller | 214/1 BB |

*Primary Examiner*—Robert J. Spar
*Assistant Examiner*—George F. Abraham
*Attorney, Agent, or Firm*—Toren, McGeady and Stanger

[57] ABSTRACT

Apparatus for changing a filled container at an ejection opening of a refuse press for an empty container comprises two wheeled carriages which are mounted on rails and are movable by hydraulic rams, one to and fro transversely from side to side of the ejection opening and the other longitudinally towards and away from the ejection opening. Each of the carriages has container supports and the transverse carriage is in two parts one on each side of the longitudinal carriage and these two parts are rigidly interconnected by a bridge beam spanning the longitudinal carriage. The carriages are movable so that as the transverse carriage is moved in one direction, one part picks up an empty container from a stationary storage support and transfers it on to the longitudinal carriage and at the same time the other part of the transverse carriage picks up a filled container from the longitudinal carriage and transfers it to a second stationary storage support. The longitudinal carriage then moves to move the empty container into position for filling against the ejection opening of the press.

4 Claims, 5 Drawing Figures

APPARATUS FOR CHANGING CONTAINERS AT AN EJECTION OPENING OF A REFUSE PRESS

This invention relates to apparatus for changing containers at an ejection opening of a refuse press. The apparatus comprises a transverse carriage having means for moving it transversely to the direction of pressing of the press and having raisable and lowerable supports for the containers, a longitudinal carriage with which the transverse carriage co-operates and which has means for moving it in the direction of pressing of the press towards and away from the ejection opening, the longitudinal carriage having a rigid support for receiving the containers in such a way that a container resting on a support of the transverse carriage can be moved by the longitudinal carriage into a pressing position at the ejection opening.

Such apparatus is used for bringing containers which are offset to the side of the ejection opening of the refuse press into a position at the opening to enable them to be filled from the opening in one or more pressing operations and, after they have been filled, for removing the containers sideways again away from the ejection opening.

For this purpose, a proposal has already been made in German Specification No. 2,160,776, for an apparatus in which two rail-mounted carriages are so adapted to each other in their construction that one carriage which is capable of moving transversely to the pressing direction of the press can travel on rails into the other carriage which is capable of moving parallel to the pressing direction of the press.

With this apparatus only one container can be changed over at one time, that is to say a container filled by the press must always first be moved to a storage platform, before the apparatus can move an empty container from another storage platform and bring it into the filling position. The apparatus also suffers from the further considerable disadvantage that travelling distances of the order of at least one to two container lengths are necessary for the longitudinal carriage, one container length being on average 10 meters. However, such distances of travel involve expensive vehicle drives mounted on the carriages with the provision of an energy supply alongside the carriage tracks, for which the installation of an electrical supply bar may, for example, be necessary. Both on account of the large number of operating steps for changing a container and also because of the comparatively long distances of travel, uneconomically long changing times are involved when loading containers. Therefore, the apparatus described in the German specification has a low efficiency, determined by the ratio between the output capacity of the refuse press and the actual turnover of refuse per unit time. It should also not be ignored that the movement of one rail-mounted carriage into the other involves considerable constructional expense and difficulty, for example for the accurate positioning of the receiving carriage relative to the rails of the running-in carriage in order to transfer the container.

The aim of the present invention is to provide apparatus for changing containers at a refuse press which shall be as simple as possible and which small permit rapid changing of containers, suited to the output capacity of the press.

According to this invention, in an apparatus as described above at the beginning of this Specification, the transverse carriage is in two parts one mounted on each side of the longitudinal carriage upon wheels, the transverse carriage having a member which spans across the longitudinal carriage and being arranged to move between limiting end positions and having its supports, which are each capable of carrying a container, on each of its two parts, and further comprising two stationary container supports, each for one container, disposed one on each side of the longitudinal carriage and arranged so that the supports of the transverse carriage can transfer containers to or from them.

With this apparatus, the result is obtained in a surprisingly simple manner that two containers can be moved at one time with a single travelling movement taking place transversely to the pressing direction of the press. Both containers are taken over by the height-adjustable supports of the transverse carriage and are moved transversely in such a manner that a full container can be moved from the opening and be set down on a stationary storage support and an empty container can be moved from the other stationary support and be set down on the longitudinal carriage in front of the opening of the refuse press. The distance which the empty container must travel from this position to bring it right up to the ejection opening of the refuse press is at most equal to the pivoting radius necessary for opening a pivoted door on the container. If containers with sliding doors are used, this distance of travel in the longitudinal or pressing direction need be only a few millimeters, the distance necessary as clearance between the container and the refuse press for opening the doors. In this way, the necessary travel distances are kept to a minimum.

In one preferred embodiment of the invention, the transverse center-to-center distance between each stationary support and the longitudinal carriage is equal to the transverse center-to-center distance between the two supports of the transverse carriage.

The result of this arrangement is that, at the start of a container changing operation, one support of the transverse carriage is situated underneath an empty container resting upon one stationary storage support, while the other support of the transverse carriage is situated under the filled container resting upon the longitudinal carriage. In this way, the lifting and setting-down of both containers can be carried out in a rational manner and always simultaneously, which leads to a further considerable saving in time.

Preferably, the member of the transverse carriage which spans across the longitudinal carriage is constructed as a bridge beam, the upper surface of which is situated below the plane of the bearing surface of the support of the longitudinal carriage. In this way, in spite of the interlocked construction of the longitudinal and transverse carriages, a sufficiently large clearance remains between the bridge beam of the transverse carriage and the support of the longitudinal carriage for the movement of the longitudinal carriage.

As a result of the extraordinarily short travel distances of the two interlocked carriages which are necessary, it is possible to construct the means by which they are moved particularly economically and robustly so that they are more reliable in operation, for example if these means each comprise a double-acting hydraulic piston-cylinder drive connected between the carriage and a stationary abutment. Apart from the aforementioned advantages, stationary drive mechanisms of this type are very simple to maintain.

An example of an apparatus constructed in accordance with the invention is illustrated in the accompanying drawings, in which.

Figure 1:
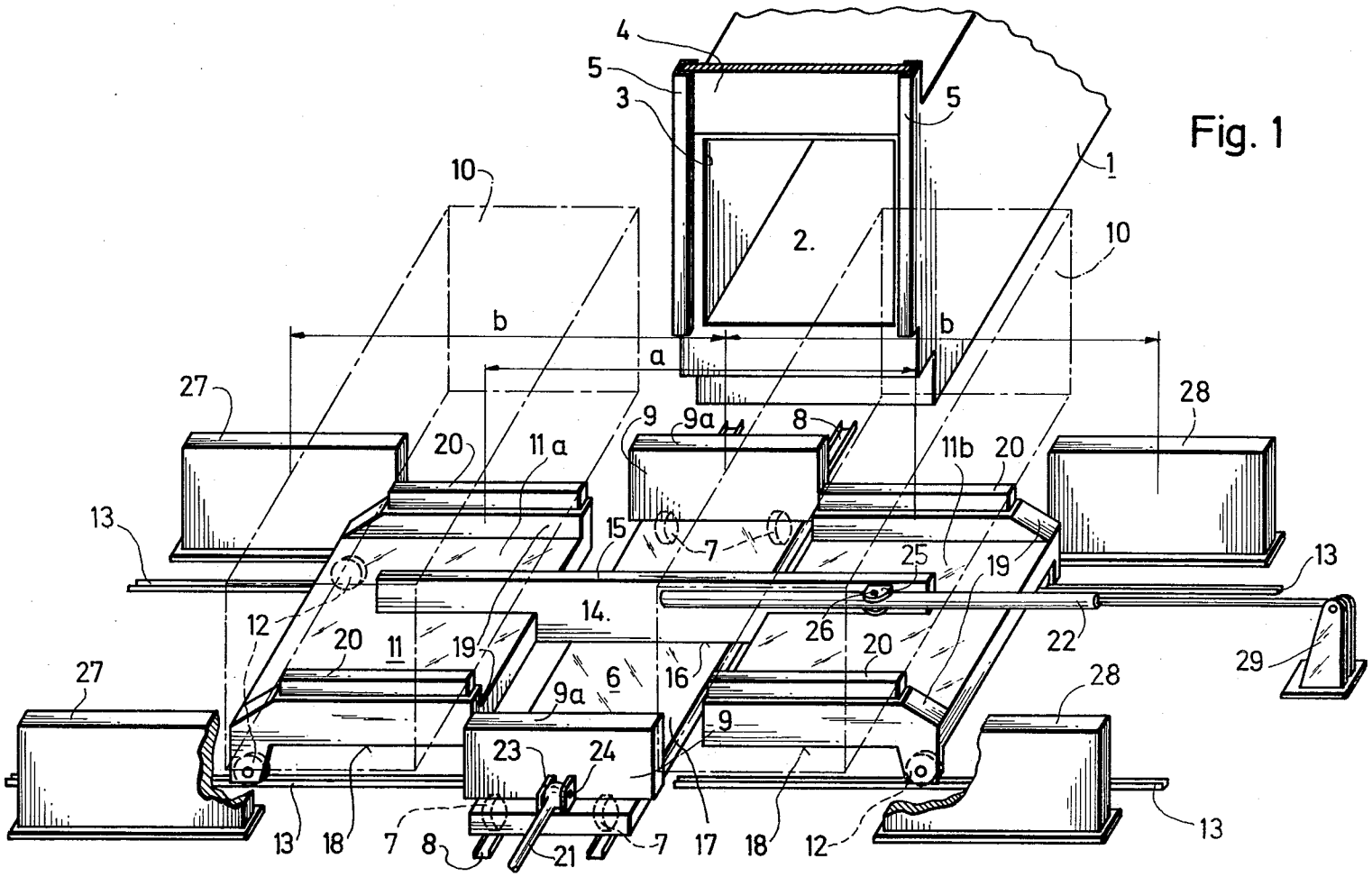
FIG. 1 is a diagrammatic perspective view of the apparatus.

The drawings show the ejection side only of a stationary refuse baling press 1. A pressing chamber 2 of the press has an ejection opening 3, which can be closed by a sliding door 4, which is only partially shown and which can be moved upwards and downwards in vertical guides 5.

Adjacent the ejection opening of the refuse press, a longitudinal carriage 6, with its wheels 7 shown in broken line, can run along rails 8. The longitudinal carriage 6 carries two fixed bearing pads 9 for receiving a container 10. The containers 10 are shown only in chain-dotted lines in all the Figures of the drawings to enable the details of the apparatus to be clearly shown.

A transverse carriage 11 is capable of travelling at right angles to the longitudinal axis of the refuse press 1, and at right angles to the movement of the carriage 6, on wheels 12 and rails 13. These rails do not cross the rails 8 for the longitudinal carriage, but stop just short of the rails 8. The transverse carriage 11 is sub-divided into two half-transverse carriages **11*a* and 11*b*, which are connected together by means of a shallow bridge beam 14, spanning across the longitudinal carriage 6. The upper face 15 of the bridge beam 14 is situated below the horizontal plane which contains bearing surfaces 9*a* of the bearing pads 9, so that no contact will occur with the bottom of a container 10, when this is resting upon the bearing pads 9. The lower face 16 of the bridge beam 14 is spaced above the floor surface 17 of the longitudinal carriage 6, so that here again no contact occurs. The undersides of the floors 18 of the half-transverse carriages 11*a*, 11*b* are above the floor surface 17 of the longitudinal carriage. Each half-transverse carriage 11*a*, 11*b* carries a pair of bearing pads 19 provided with bearing beams 20, which can be raised and lowered. These bearing beams can be raised above and be lowered below the horizontal plane which contains the bearing surfaces 9*a*. The longitudinal carriage 6 and the transverse carriage 11 are coupled to double-acting hydraulic piston-cylinder drives 21 and 22 respectively. In FIG. 1, only the piston rod of the drive 21 is shown and this is connected to the longitudinal carriage by a fork 23 fixed to that carriage and a pin 24. The drive 22 is connected to the bridge beam 14 of the transverse carriage 11 by means of a fork head 25 and a pin 26 and to a stationary abutment 29. The drives 21, 22 may in fact with advantage be disposed underneath the carriages 6 and 11, so that they are protected from damage by falling material. The two half-transverse carriages 11*a* and 11*b* are each flanked by a pair of stationary storage platforms 27 and 28, the upper faces of which are preferably situated in the horizontal plane which contains the bearing surfaces 9*a*. The pair of storage platforms 27 serves for holding ready an empty container 10, whereas the pair of storage platforms 28** is provided for setting down a filled container. The horizontal center-to-center distance *a* between the two pairs of bearing pads 19 of the transverse carriage 11 is preferably equal to the center-to-center distance *b* between one pair of platforms 27 or 28 and the pair of bearing pads 9 of the longitudinal carriage 6. The result of this is that, in the two limiting positions of the transverse carriage 11, one of the half-transverse carriages will be situated between one pair of storage platforms 27 or 28 while the other half-transverse carriage will be situated above the longitudinal carriage 6. In the operating position shown in FIG. 1, the transverse carriage 11 has already taken over two containers 10, one from the pair of storage platforms 27 and the other from the bearing pads 9 of the longitudinal carriage and is situated in a position on its way towards its right-hand limiting position. The individual operating positions of the apparatus will now be described.

Figure 2:
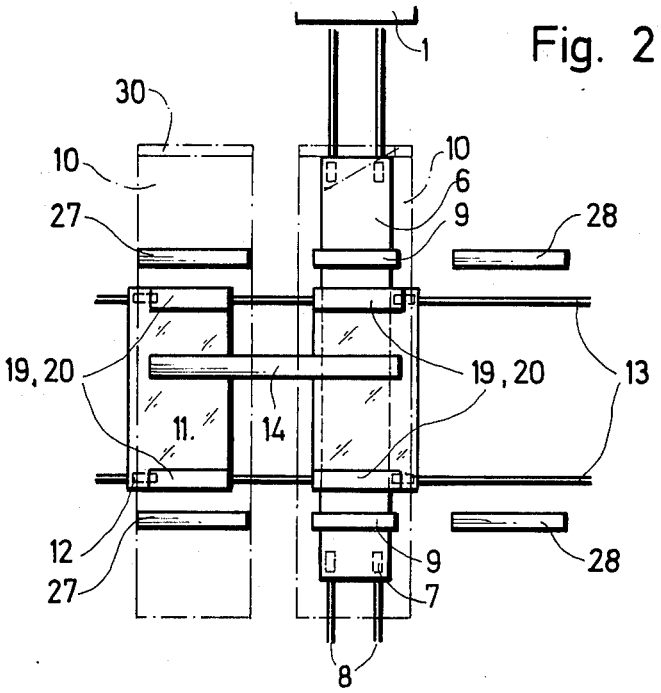
FIGS. 2 to 5 are diagrammatic plan views of the apparatus shown at four different stages of operation.

In the position shown in FIG. 2, the transverse carriage 11 is situated in its left-hand end position. The half-transverse carriage **11*a* is now between the pair of storage platforms 27, upon which an empty container 10 rests. The container has been set down by means of a crane or the like. The half-transverse carriage 11*b* is over the longitudinal carriage 6 between the bearing pads 9, upon which is filled container 10 rests. In this operating position, the bearing beams 20 of both half-transverse carriages are raised simultaneously by hydraulic or mechanical means, so that the empty container is raised from the pair of storage platforms 27 and the full container is raised from the bearing pads 9. The transverse carriage 11 then travels with the two containers 10 into its right-hand end position shown in FIG. 3**.

Figure 3:
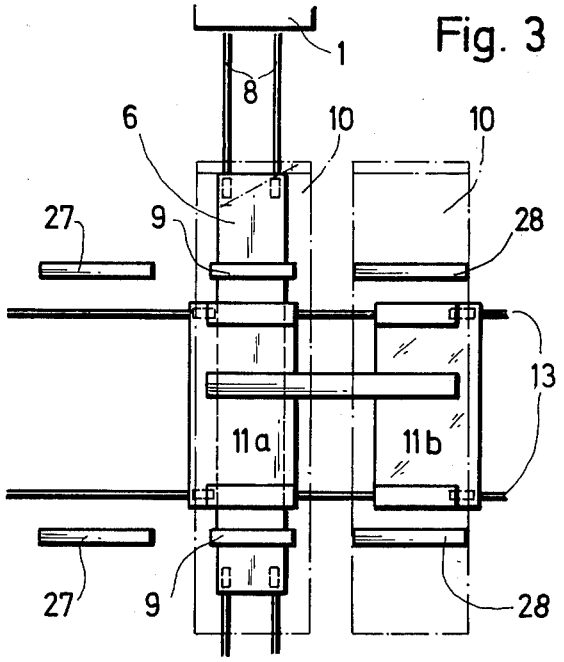

In the position shown in FIG. 3, the bearing beams 20 are lowered, so that the full container is set down upon the pair of storage platforms 28 and the empty container is set down upon the bearing pads 9 of the longitudinal carriage 6. The full container is then lifted, by a crane or the like, from the storage platforms 28 and is set down on an awaiting transportation vehicle.

Figure 4:
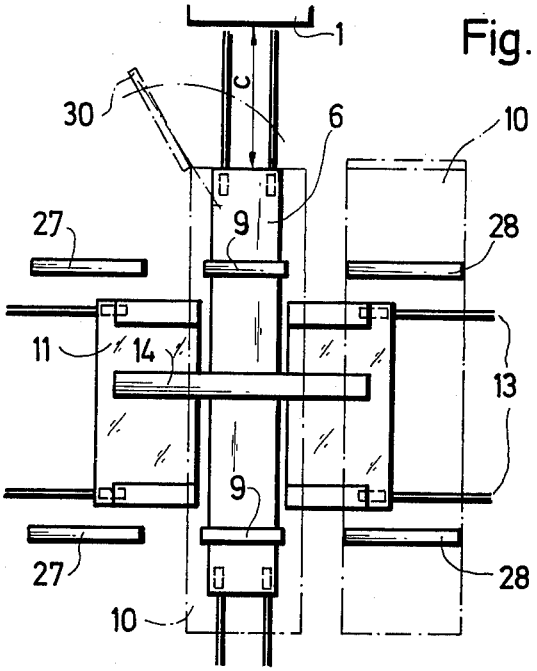

After the two containers 10 have been set down, the transverse carriage 11 travels into the middle position shown in FIG. 4. In the operating positions shown in FIGS. 2 to 4, the longitudinal carriage is at a distance *c* from the ejection opening of the refuse press 1. This distance only needs to be sufficiently large for the door 30 of the container 10 to be able just to swing into the position shown in FIG. 4.

Figure 5:
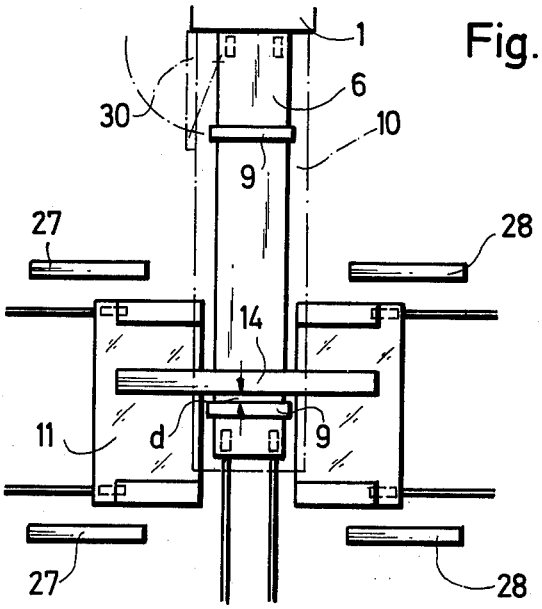

In FIG. 5, the longitudinal carriage 6 has been advanced by the distance *c*, so that the container 10 rests against the ejection opening 3 of the refuse press 1. The door 3 of the container is at this time already folded back alongside the container and the container is connected by couplings of a known type to the refuse press 1. The distance between the bearing pads 9 of the longitudinal carriage is sufficiently large that, in the operating position shown in FIG. 5, there is still a clearance *d* between the bridge beam 14 of the transverse carriage 11 and the rear bearing pad 9 of the longitudinal carriage.

After the container has been filled with refuse, the longitudinal carriage 6 is first moved into the position shown in FIG. 2 and then the transverse carriage 11 is moved into its position shown in FIG. 2. In the meantime, an empty container has again been raised from a transportation vehicle and set down on the pair of storage platforms 27, so that a new cycle of changing operations can now be carried out in the manner already described.

I claim:

1. In apparatus for changing containers at an ejection opening of a refuse press, said apparatus comprising a transverse carriage, means for moving said transverse carriage in a direction transversely of a direction of pressing of said press, container supports on said transverse carriage, means for raising and lowering said supports, a longitudinal carriage with which said transverse carriage is arranged to co-operate, means for moving said longitudinal carriage in said direction of pressing towards and away from said ejection opening, and a rigid container support on said longitudinal carriage, said supports of said transverse carriage and said support of said longitudinal carriage being so arranged that a container resting on a support of said transverse carriage can be moved by said support of said longitudinal carriage into a pressing position at said ejection opening, the improvement wherein said transverse carriage comprises a first part and a second part, wheels movably mounting said first part on one side of said longitudinal carriage, further wheels movably mounting said second part on an opposite side of said longitudinal carriage, a member spanning said longitudinal carriage and rigidly interconnecting said first part and said second part of said transverse carriage, two stationary container storage supports, said stationary container storage supports being disposed one at one side of said longitudinal carriage and the other at an opposite side of said longitudinal carriage and being so located that said supports of said transverse carriage are capable of transferring containers to and from said stationary container storage supports and said means for moving said transverse carriage being adapted to move said carriage between first and second limiting end positions and said supports of said transverse carriage being located one on said first part and the other on said second part of said transverse carriage.

2. Apparatus as claimed in claim 1, wherein a transverse center-to-center distance between each of said stationary container storage supports and said longitudinal carriage is equal to a transverse center-to-center distance between said support on said first part of said transverse carriage and said support on said second part of said transverse carriage.

3. Apparatus as claimed in claim 1, wherein said means spanning said longitudinal carriage comprises a bridge beam, means rigidly fixing one end of said bridge beam to said first part of said transverse carriage and means rigidly fixing an opposite end of said beam to said second part of said transverse carriage and said bridge beam having an upper surface which is situated below a plane containing a bearing surface of said support of said longitudinal carriage.

4. Apparatus as claimed in claim 1, wherein said means for moving said transverse carriage and said means for moving said longitudinal carriage each comprise double-acting hydraulic piston-cylinder means, means connecting said hydraulic piston-cylinder means to said carriage, a stationary abutment and means connecting said hydraulic piston-cylinder means to said stationary abutment.

* * * * *